US012790075B2

(12) United States Patent
Threndyle et al.

(10) Patent No.: US 12,790,075 B2
(45) Date of Patent: Nov. 10, 2026

(54) SAMPLING BAG CARRYING APPARATUS

(71) Applicant: Merq Inc., Stoney Creek (CA)

(72) Inventors: Kyle Daniel Threndyle, Stoney Creek (CA); Farouk Saleh, Stoney Creek (CA); Samee Syed, Stoney Creek (CA)

(73) Assignee: Merq Inc., Stoney Creek (CA)

( * ) Notice: Subject to any disclaimer, the term of this patent is extended or adjusted under 35 U.S.C. 154(b) by 0 days.

(21) Appl. No.: 18/771,310

(22) Filed: Jul. 12, 2024

(65) Prior Publication Data

US 2025/0019124 A1 Jan. 16, 2025

Related U.S. Application Data

(60) Provisional application No. 63/526,657, filed on Jul. 13, 2023.

(51) Int. Cl.
*B65D 33/14* (2006.01)

(52) U.S. Cl.
CPC ..... *B65D 33/14* (2013.01)

(58) Field of Classification Search
CPC ..... B65D 33/14
See application file for complete search history.

(56) References Cited

U.S. PATENT DOCUMENTS 3,558,039 A * 1/1971 Schmidt ..... B29C 66/54 383/34
3,861,630 A * 1/1975 Ady ..... B65B 67/125 248/101
4,387,846 A * 6/1983 DuCorday ..... B65D 33/1683 383/15
D407,310 S * 3/1999 DuCorday ..... D9/434
8,356,850 B1 * 1/2013 Starkweather ..... F25C 5/00 294/158

(Continued)

FOREIGN PATENT DOCUMENTS

CA 2770758 A1 * 3/2012
EP 2292206 B1 * 12/2012 ..... A61J 1/1462

(Continued)

OTHER PUBLICATIONS

Adsure RFID security bags online product page dated by archive.org to Jun. 20, 2021 https://adsurepackaging.com/product-item/rfid-security-bags/ (Year: 2021).*

(Continued)

*Primary Examiner* — Terrell L McKinnon
*Assistant Examiner* — Ding Y Tan
(74) *Attorney, Agent, or Firm* — Smart & Biggar LP

(57) ABSTRACT

Carriers for a sampling bag are described herein. The carriers have a body having a first segment; a second segment; and a central segment integrated with and extending between the first segment and the second segment. The central segment is laterally spaced apart from a longitudinal axis of the body. The first segment and the second segment are coaxial with the longitudinal axis. The carrier also includes a pair of clamps coupled to the body and spaced apart from each other along the longitudinal axis. Each clamp of the pair of clamps is configured to retain the sampling bag against the body of the carrier when the sampling bag is hanging downwardly relative to the body.

18 Claims, 9 Drawing Sheets

(56) References Cited

U.S. PATENT DOCUMENTS

| | | | | |
|---|---|---|---|---|
| 9,033,291 | B2 * | 5/2015 | Branham | B65B 67/1211 248/101 |
| 9,074,920 | B2 * | 7/2015 | Mendels | G01F 23/2921 |
| 10,836,525 | B1 * | 11/2020 | Alspaugh | B65B 43/30 |
| 2012/0294782 | A1 | 11/2012 | Francesco | |
| 2021/0380314 | A1 * | 12/2021 | Collis | A44B 99/00 |

FOREIGN PATENT DOCUMENTS

| | | | | |
|---|---|---|---|---|
| EP | 2524595 | B1 * | 6/2014 | G01N 1/31 |
| JP | S5213688 | | 1/1977 | |
| JP | S5213688 | U * | 12/1978 | |

OTHER PUBLICATIONS

VMECA "Demo, Pick and Place, Magic Grippers @Doosan Robotics" youtube video dated Nov. 2, 2022, https://www.youtube.com/watch?v=Jdl-0k2KjYA (Year: 2022).*

European Patent Office, Extended European Search Report for Application No. EP 24188707, dated Nov. 19, 2024.

* cited by examiner

500

SAMPLING BAG CARRYING APPARATUS

CROSS-REFERENCE

The present application claims priority to U.S. Provisional Patent Application No. 63/526,657 titled SAMPLING BAG CARRYING APPARATUS filed on Jul. 13, 2023, the entire contents of which are hereby incorporated by reference in their entirety.

TECHNICAL FIELD

The embodiments disclosed herein relate to carriers for sampling bags, and more specifically to carriers for sampling bags used in food safety testing.

BACKGROUND

The following paragraphs are not an admission that anything discussed in them is prior art or part of the knowledge of persons skilled in the art.

Currently, food testing is manually intensive and often performed by lab technicians with support equipment to help augment labor, where possible. In simple terms, a sterile plastic bag is commonly used as a container or vessel to hold the food sample being testing. Although there are different bags used in various processes, one of the most common bags used in food safety testing is sold under the trade name Stomacher® bag.

Typically, a food sample is initially weighed into the sample bag. The target weight is typically specified by regulatory methods. Presently, the sampling bag used to hold the sample is held in a stand during the filling process. Media, or bacteriological media which is a nutrient-rich growth medium, is added to the sample bag to help encourage cell recovery and bacteria growth. The sample is then homogenized and thoroughly mixed in a device before being taken to an incubator for growth and/or enrichment. After the sample has incubated in the incubator, the sample is subsampled and tested to eventually yield a result.

In another form of testing commonly performed, once the sample is added to the Stomacher® bag, a buffer (e.g. liquid) is added to the bag and the sample is homogenized. The sample is then processed using serial dilutions and then plated on agar petri dishes or equivalent. Once plated, they are taken away for incubation and subsequently processed and tested further after incubation.

Unfortunately, as noted above, the processes described above are labour intensive and have proved difficult to automate. The physical properties of the Stomacher® bags have particularly led to some of these difficulties. The Stomacher® bags are typically square sealed bags and used for handling samples of, for example, a volume in a range of about 80 mL to about 3,375 mL. Therefore, any carrier that is developed to be used in automated processes needs to be able to releasably carry the sampling bag and be configured to not tear or stretch the bag. The Stomacher® bags are generally made from high quality food grade virgin low density polyethylene (LDPE) granules extruded to 65 um film thickness and irradiated to be sterile. Care therefore needs to be taken to avoid inserting anything into the bag that isn't the sample being tested.

Accordingly, in view of the above, there is a need to develop new carriers for sampling bags and, more specifically, new carriers for sampling bags used in food safety testing.

SUMMARY

In accordance with a broad aspect, a carrier for a sampling bag is described herein. The carrier has a body having a first segment; a second segment; and a central segment integrated with and extending between the first segment and the second segment. The central segment is laterally spaced apart from a longitudinal axis of the body. The first segment and the second segment are coaxial with the longitudinal axis. The carrier also includes a pair of clamps coupled to the body and spaced apart from each other along the longitudinal axis. Each clamp of the pair of clamps is configured to retain the sampling bag against the body of the carrier when the sampling bag is hanging downwardly relative to the body.

In at least one embodiment, the first segment includes a free end and a joined end, the joined end being coupled to the central segment of the carrier.

In at least one embodiment, the second segment includes a free end and a joined end, the joined end being coupled to the central segment of the carrier.

In at least one embodiment, the central segment comprises a first portion and a second portion, the first portion of the central segment being coupled to the joined end of the first segment and the second portion of the central segment being coupled to the joined end of second segment.

In at least one embodiment, the central portion further comprises a middle portion coupled to each of the first portion and the second portion.

In at least one embodiment, the pair of clamps includes a first clamp and a second clamp, the first clamp being positioned between the free end and the joined end of the first segment and the second clamp being positioned between the free end and the joined end of the second segment.

In at least one embodiment, each clamp of the pair of clamps is one of a c-clamp, a screw clamp, a hand screw clamp, a spring clamp, a bar clamp, a hose clamp, a magnetic clamp, a pneumatic clamp, and a clip.

In at least one embodiment, the body has a ribbon-like shape having a length greater than a height and the height greater than a thickness.

In at least one embodiment, the body has a ribbon-like shape having a length greater than a height and the height less than a thickness.

In at least one embodiment, the body as a top edge, a bottom edge, a first side and a second side, the first side and the second side extending between the top edge and the bottom edge.

In at least one embodiment, the central portion is offset laterally in a direction towards the second side of the body.

In at least one embodiment, each clamp of the pair of clamps is a compression clamp having a spring coupled to the second side of the body and a lever hingedly coupled to the spring and extending though an aperture of the body, the lever being configured to retain the sampling bag against the body of the carrier.

In at least one embodiment, the lever has an inner surface and an outer surface, the inner surface contacting the sampling bag when each clamp is in a first position.

In at least one embodiment, each clamp has a first position and a second position and is biased to the first position, the first position being configured to retain the sampling bag against the carrier and the second position being configured to release the sampling bag from the carrier.

In at least one embodiment, the carrier is retaining the sampling bag, the sampling bag generally extends along the longitudinal axis of the carrier and the central segment being laterally spaced apart from the longitudinal axis provides for the sampling bag to be opened when retained by the carrier.

In at least one embodiment, the lever has a U-shape.

In at least one embodiment, the first end of the carrier is configured to be retained in a rack of a sampling bar carrier shelving unit.

In at least one embodiment, the carrier further comprises a radio frequency identification (RFID) tag positioned on a second end of the carrier.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein and to show more clearly how these various embodiments may be carried into effect, reference will be made, by way of example, to the accompanying drawings that show at least one example embodiment which are now described. The drawings are not intended to limit the scope of the teachings described herein.

Further aspects and features of the example embodiments described herein will appear from the following description taken together with the accompanying drawings.

DETAILED DESCRIPTION

Various compositions and methods will be described below to provide an example of one or more embodiments. No embodiment described below limits any claimed embodiment and any claimed embodiment may cover compositions or methods that differ from those described below. The claimed embodiments are not limited to compositions and methods having all of the features of any one composition or method described below or to features common to multiple or all of the compositions and methods described below. It is possible that a composition or method described below is not an embodiment of any claimed embodiment. Any embodiment disclosed below that is not claimed in this document may be the subject matter of another protective instrument, for example, a continuing patent application, and the applicants, inventors or owners do not intend to abandon, disclaim or dedicate to the public any such embodiment by its disclosure in this document.

The problems to be solved by the present disclosure are not limited to the above-mentioned problem(s), and other problem(s) not mentioned can be clearly understood by those skilled in the art from the following description.

Figure 1:
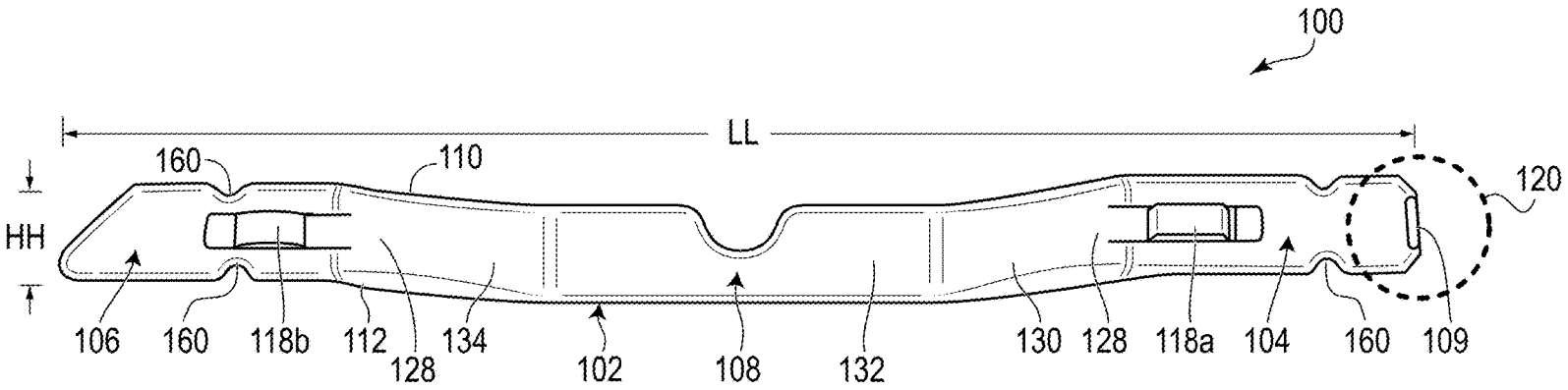
FIG. 1 is a front view of a sampling bag carrier, according to at least one embodiment described herein.
Figure 2:
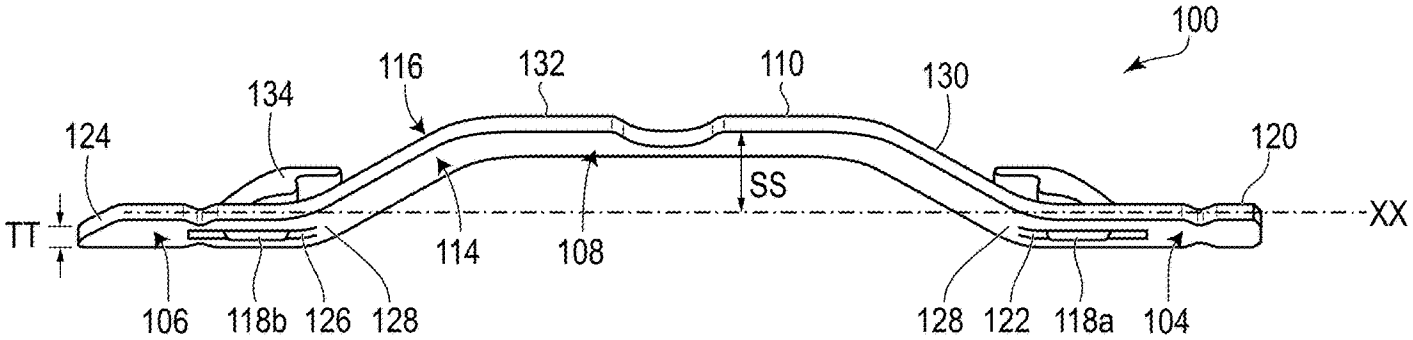
FIG. 2 is a top view of the sampling bag carrier of FIG. 1.
Figure 3:
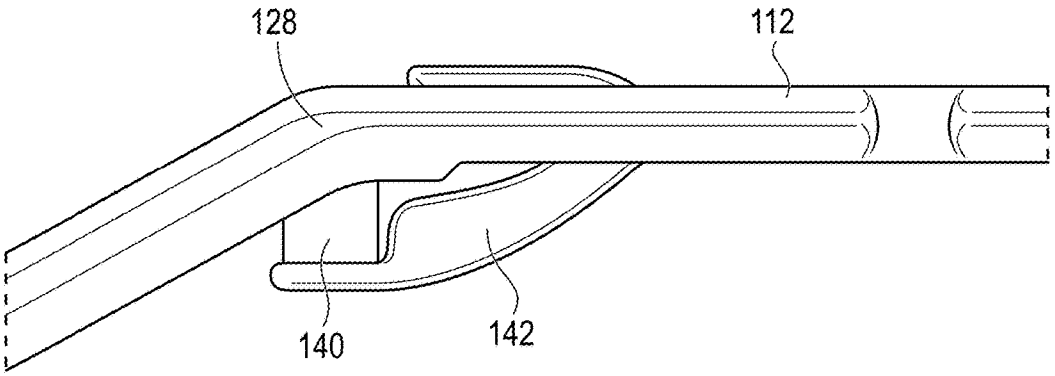
FIG. 3 is a magnified rear perspective view from below of a clamp of the sampling bag carrier of FIG. 1.
Figure 4:
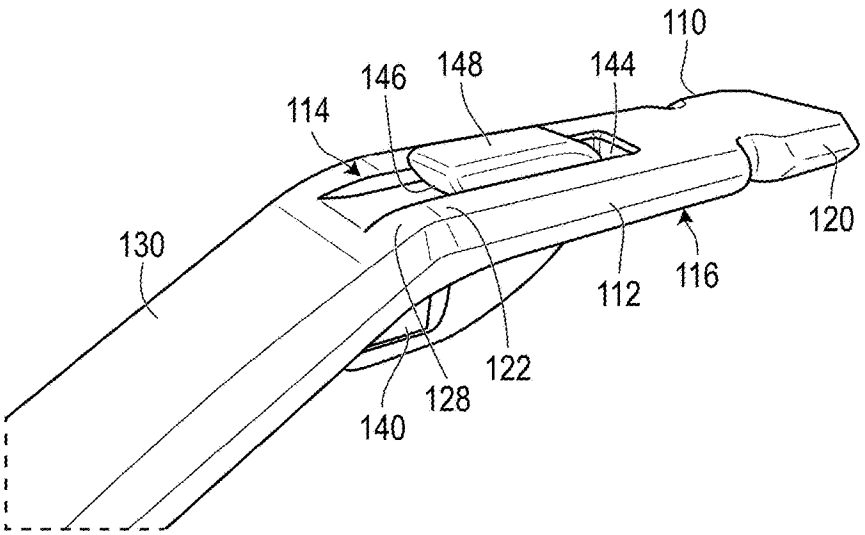
FIG. 4 is a magnified top perspective view from above of a clamp of the sampling bag carrier of FIG. 1.

In general, the present document is directed to an apparatus for carrying a sampling bag. Turning to FIGS. 1 and 2, illustrated therein is a carrier 100 for carrying a sampling bag.

Carrier 100 includes a body 102 having a first segment 104, a second segment 106 and a central segment 108. Although the first segment 104, second segment 106 and central segment 108 are clearly differentiated in the embodiments shown in the drawings, it should be understood that in other embodiments the first segment 104, second segment 106 and central segment 108 may be integral with each other and may be divided by bends and/or coupling points.

Figure 5:
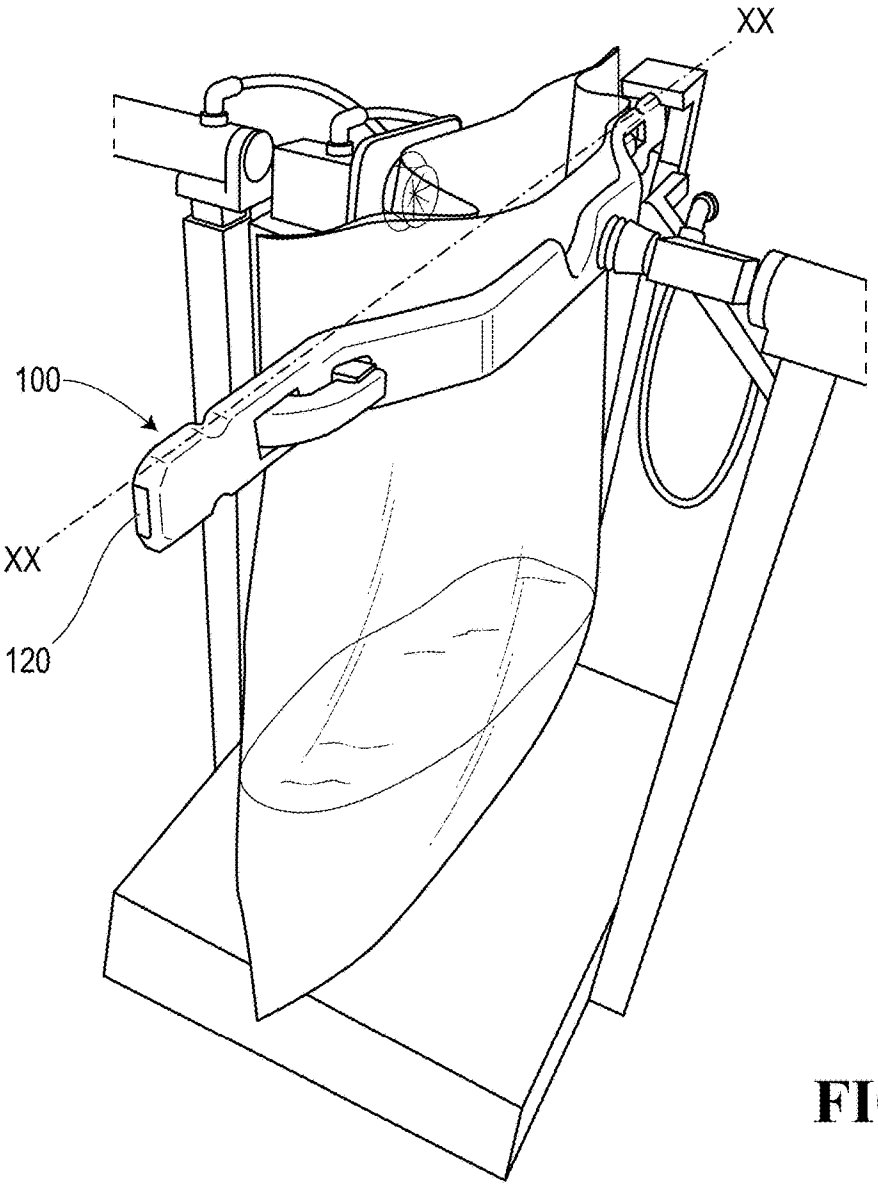
FIG. 5 is a perspective view from above of a system for testing a sample of food according to at least one embodiment described herein, the system including the sampling bag carrier of FIG. 1.
Figure 6:
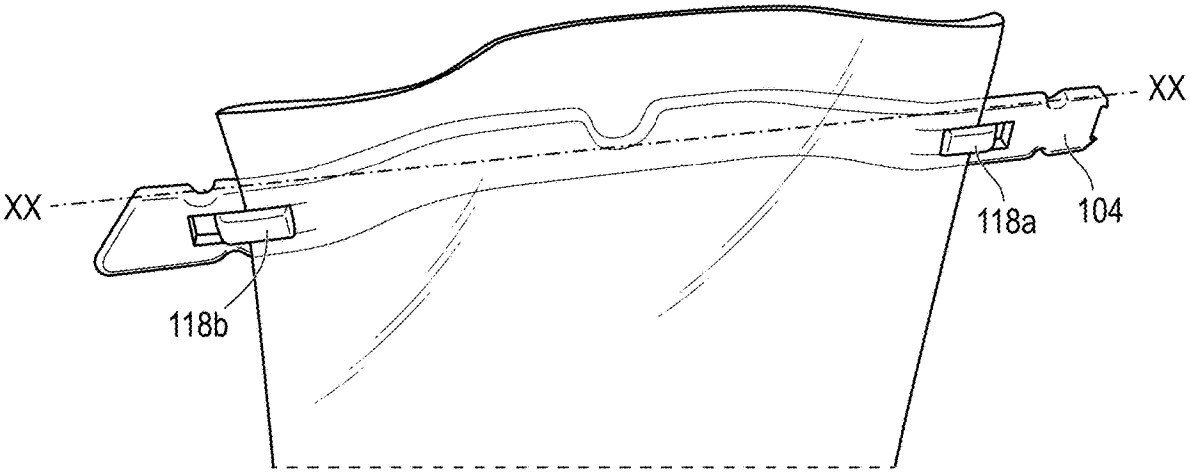
FIG. 6 is a perspective view of the sampling bag carrier of FIG. 1 carrying a sampling bag.
Figure 7:
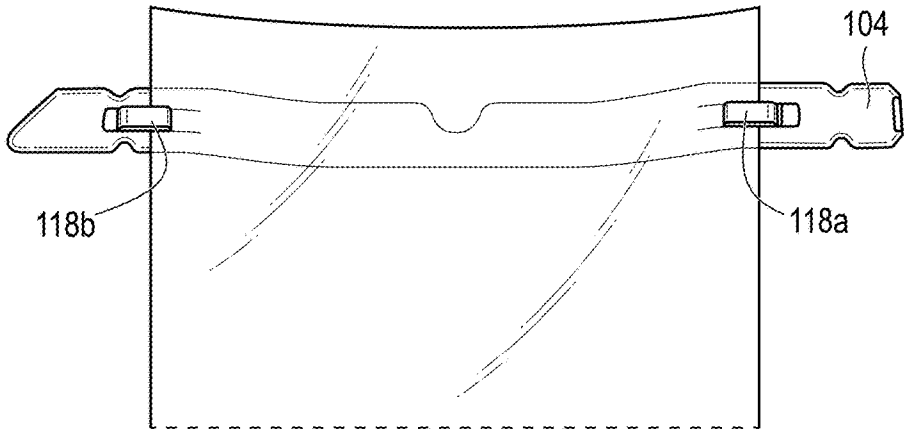
FIG. 7 is a front view of the sampling bag carrier of FIG. 1 carrying a sampling bag.

Body 102 is typically made of aluminum, plastic or composites. In the embodiments shown in the drawings, body 102 has a ribbon-like shape having a length LL that is greater than a height HH. For example, in at least one embodiment, the length LL may be about 20 inches. For example, in at least one embodiment, the height HH may be about 1.5 inches. Further, in at least one embodiment, the height HH of the body is greater than a thickness TT of the body. For example, in at least one embodiment, the thickness TT may be about 0.375 inches. In the embodiments shown in the drawings, the ribbon-like shape of body 102 provides for the carrier 100 to be easily transported by, for example, a robot. Further, the ribbon-like shape of body 102, and particularly the thickness TT of the body 102 being about 0.375 inches, corresponds with the flat, square nature of most sampling bags and provides for the carrier 100 and a sampling bag carried by the carrier 100 (for example as shown in FIGS. 5-7) to be efficiently stored (i.e. with minimal spacing between adjacent carriers and bags) in a storage cabinet, incubator, or the like, as described in further detail below. Further, the ribbon-like shape of body 102 may provide for efficiently closing of the sampling bag, such as by rotating the body 102 about the longitudinal axis XX, thereby folding an upper portion of the sampling bag over itself and closing the bag.

Returning to FIGS. 1 and 2, body 102 has a top edge 110, a bottom edge 112, a first side 114 and a second side 116. The first side 114 and the second side 116 extend from the top edge 110 to the bottom edge 112. First side 114 and the second side 116 are separated by thickness TT and top edge 110 and bottom edge 112 are separated by height HH.

First segment 104 and second segment 106 are each configured to support at least one clamp 118. For example, in the embodiments shown in the drawings, first segment 104 includes a free end 120 and a joined end 122. Joined end 122 is coupled to, or integral with, central segment 108.

Likewise, second segment 106 includes a free end 124 and a joined end 126. Joined end 126 is coupled to, or integral with, central segment 108 of the carrier 100. Each clamp 118, described in greater detail below, is supported by one of first segment 104 and second segment 106. In at least one embodiment, free end 120 may be configured to support a radio frequency identification (RFID) tag 109. In at least one embodiment, placing the RFID tag 109 at free end 120 may provide for an RFID reader in the gripper of the robot to passively scan the RFID tag.

In the embodiment shown in the drawings, each of joined ends 122 and 126 of first segment 104 and second segment 106, respectively, are integral with central segment 108 at a bend 128. It should be understood that although first segment 104 and second 106 are shown as being linear segments, they should not be limited to being linear. First segment 104 and second segment 106 may have a different shape than is shown in the drawings. As noted above, first segment 104 and second segment 106 may have any shape that provides for each to support at least one clamp 118.

Central segment 108 extends between first segment 104 and second segment 106. Central segment 108 extends from first segment 104 to second segment 106 to support the second segment 106 when first segment 104 is coupled to a rack or a shelf, as described below. By doing so, when clamps 118 are coupled to or retaining a sampling bag filled with a sample (e.g. liquid sample), carrier 100 can be releasably attached to a rack, a shelf, a cart, an incubator, or the like and support the sampling bag holding the sample above the ground.

Central segment 108 is at least partially laterally spaced from a longitudinal axis XX passing through the first segment 104 and the second segment 106. Axis XX is shown as a dashed line on FIG. 2, for reference. In at least one embodiment, central portion 108 is offset laterally from longitudinal axis XX in a direction towards the second side 116 of the body 102.

Figure 8:
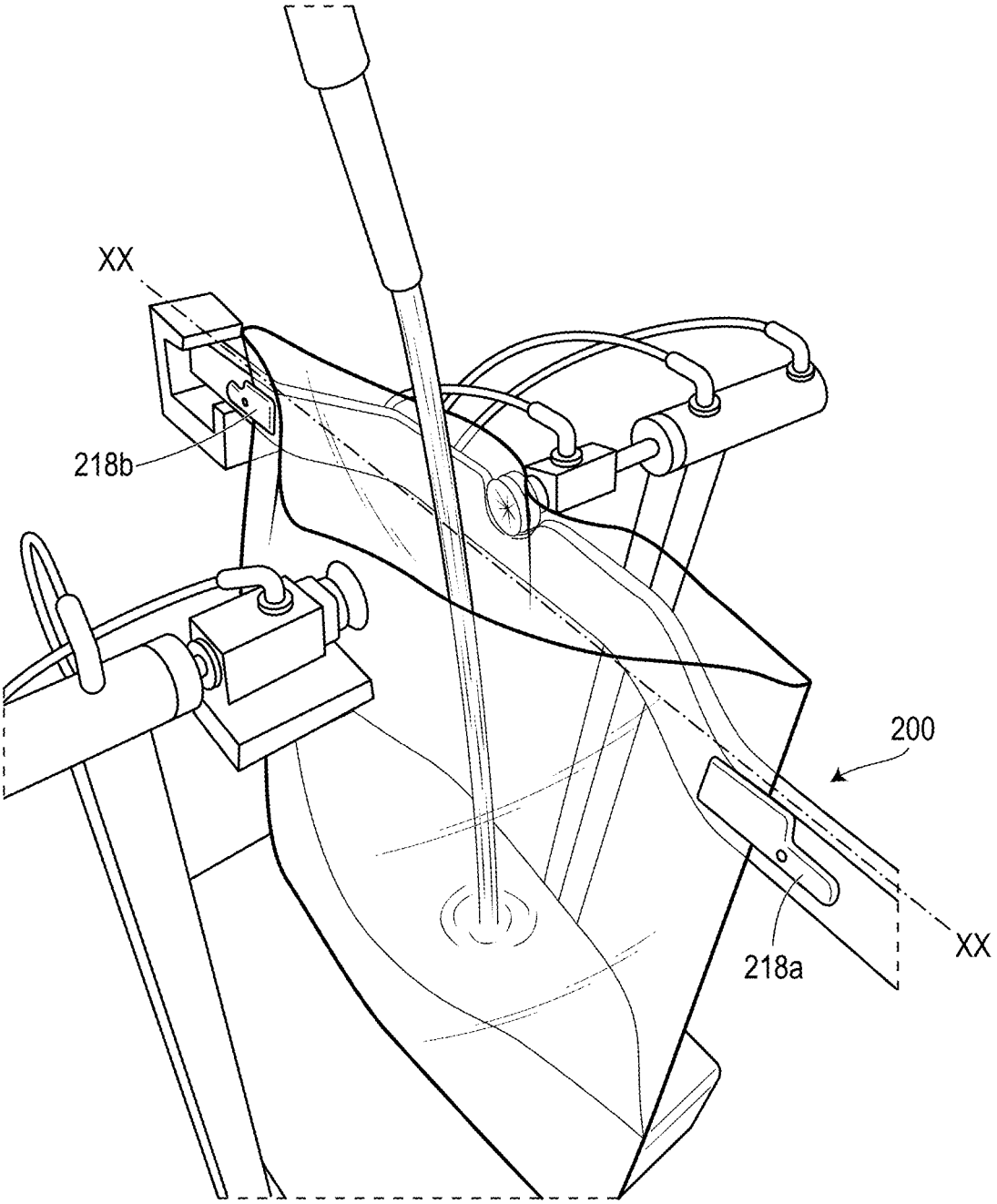
FIG. 8 is a perspective view from above of a system for testing a sample of food according to at least one embodiment described herein, the system including a sampling bag carrier according to another embodiment described herein.
Figure 10:
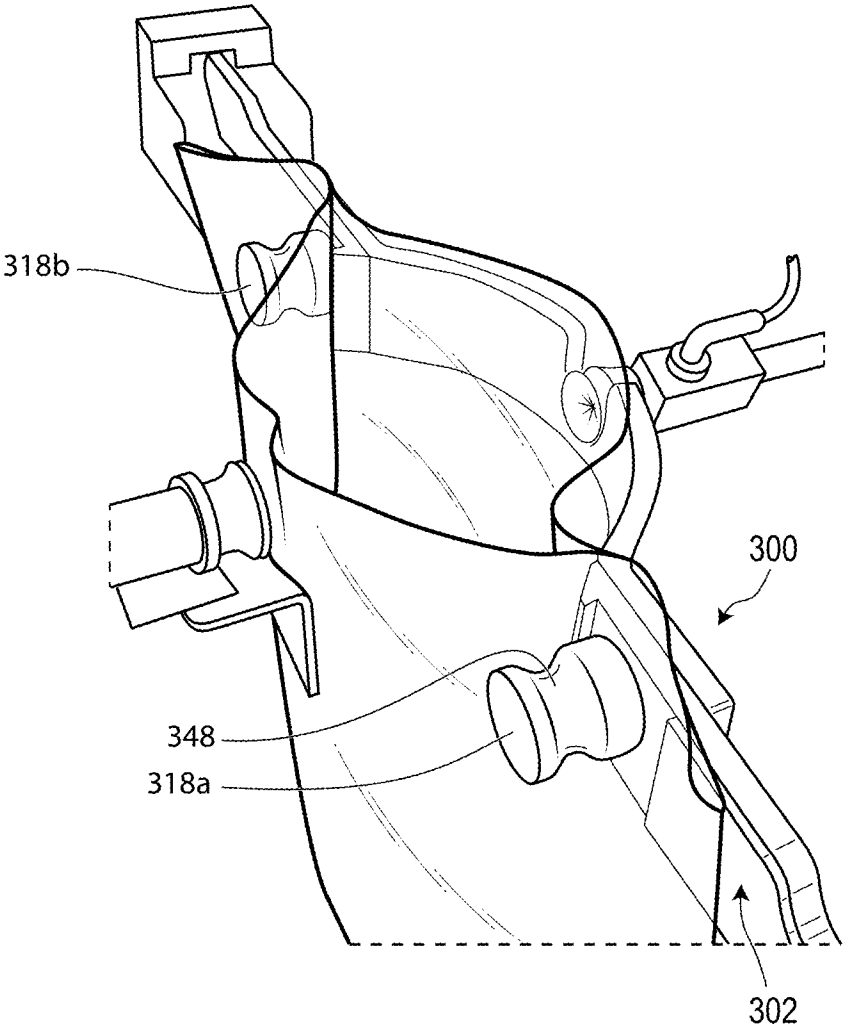
FIG. 10 is a perspective view from above of another system for testing a sample of food according to at least one embodiment described herein, the system including a sampling bag carrier according to another embodiment described herein.

By being laterally spaced apart from the longitudinal axis XX, central segment 108 provides for a user or piece of machinery, such as but not limited to a robot, to more easily open the sampling bag. As described in greater detail below, each sampling bag is retained against the carrier 100 by two clamps 118 spaced apart from each other along the longitudinal axis XX. To open the sampling bag, for example as shown in FIGS. 5, 8 and 10, two pieces of the plastic film forming the sampling bag are pulled apart from each other in a direction away from each other. In the embodiments shown, at least a portion of central segment 108 is laterally spaced apart from the longitudinal axis XX, along which the sampling bag is positioned when it is clamped by the clamps 118, to provide a space SS for one of the pieces of the sampling bag to enter to open the sampling bag. Further, at least a portion of central segment 108 being laterally spaced apart from the longitudinal axis XX may also provide a space SS for a piece of machinery to enter to engage with the piece of the sampling bag to pull it apart from the other piece of the sampling bag. Put another way, lateral space SS provides for one or both sides of the sampling bag to open.

In the embodiments shown in the drawings, the central segment 108 is formed by three linear segments that are joined at obtuse angles. However, central segment 108 should not be limited to the arrangement shown in the drawings. For example, central segment 108 may comprise a single curved segment that also provides space SS between a portion of the central segment 108 and the longitudinal axis XX.

That said, in the embodiments shown in the drawings, central segment 108 comprises a first portion 130, a second portion 132 and a third portion 134. These are each shown in FIG. 1 and FIG. 2.

First portion 130 is integral with or coupled to joined end 122 of first segment 104 and third portion 134 of central segment 108 is coupled to the joined end 126 of second segment 106. Second portion 132, also referred to as a middle portion of the central segment 108, is coupled to each of the first portion 130 and the third portion 134. In the embodiments shown in the drawings, first portion 130 is integral with or coupled to joined end 122 of first segment 102 at a point along the longitudinal axis XX and third portion 134 of central segment 108 is coupled to the joined end 126 of second segment 106 at a point along the longitudinal axis XX. Conversely, second portion 132 is coupled to each of the first portion 130 and the third portion 134 at points that are laterally spaced apart from the longitudinal axis XX.

As noted above, the carrier 100 also includes at least a pair of clamps 118. Clamps 118 are spaced apart from each other along the longitudinal axis XX passing through the first segment 104 and the second end 106 of body 102. Each clamp has a first position and a second position and is biased to the first position, the first position being configured to retain the sampling bag against the carrier and the second position being configured to release the sampling bag from the carrier. Clamps 118 are spaced apart from each other along the longitudinal axis XX by a distance that is less than a width of the sampling bag.

Each clamp 118 of the pair of clamps is configured to retain a sampling bag against at least a portion of the body 102 (e.g. against a portion of first segment 104 or second end 106) when the sampling bag is hanging downwardly relative to the body.

In the embodiments shown in the drawings, carrier 100 a first clamp 118*a* and a second clamp 118*b*, the first clamp 118*a* being positioned between the free end 120 and the joined end 122 of first segment 104 and the second clamp 118*b* being positioned between the free end 124 and the joined end 126 of the second segment 106.

Each clamp 118*a*, 118*b* may be any clamping mechanism that is suitable for supporting the sampling bag and a sample therein to the carrier 100. For example, the clamps may be one of a c-clamp, a screw clamp, a hand screw clamp, a spring clamp, a bar clamp, a hose clamp, a magnetic clamp, a pneumatic clamp, a clip, or the like.

In the embodiment shown in FIGS. 1-7, each of clamps 118*a* and 118*b* is a spring clamp having a spring 140 coupled to second side 116 of body 102 and a lever 142 hingedly coupled to the spring 140 and extending though an aperture 144 of the body 102.

Spring 140 can be any type of spring that biases in tension and is compressible. For example, in the embodiment of FIGS. 1-7, spring 140 is a rubber spacing block.

In the embodiment of carrier 100 shown in FIGS. 1-7, lever 142 generally has a U-shape and extends from a hinged coupling point, where one or more pins (not shown) couple the lever 142 to spring 140, through aperture 144 of body 102 and presses against first side 114 of body 102. More specifically, lever 142 has an inner surface 146 and an outer surface 148. Inner surface 146 contacts the sampling bag when each clamp 118 is in a first position, the first position being defined by the position of lever 142 when spring 140 is at its natural orientation. To move the clamps 118*a*, 118*b* between the first and second position, a force is applied to lever 142 adjacent to the spring 140. For example, a user may press on the lever 142 adjacent to the spring 140 or a pneumatic fixture of a robot, or similar machine, may press on the lever 142 adjacent to the spring 140.

Figure 9:
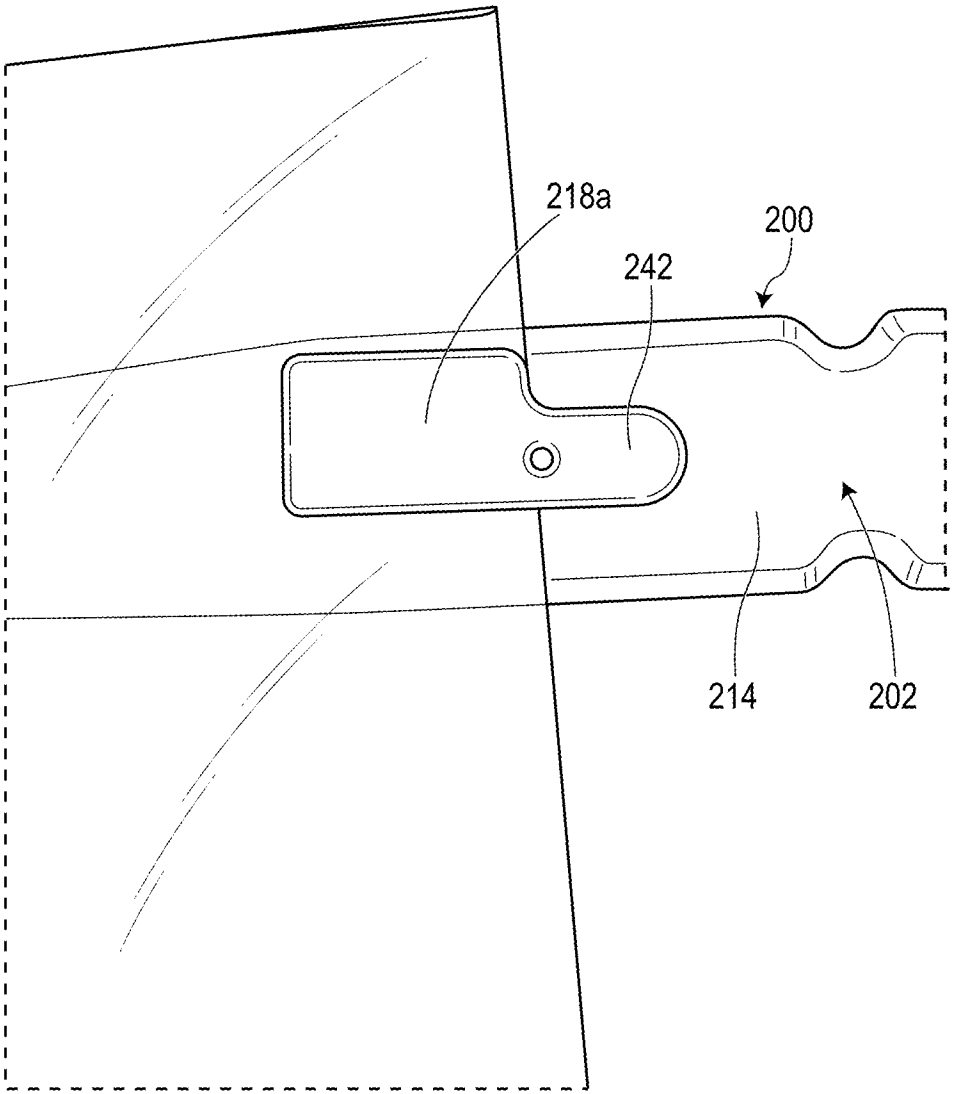
FIG. 9 is a magnified front view of a clamp of the sampling bag carrier of the system of FIG. 8.

FIGS. 8 and 9 show another embodiment of a carrier 200 having clamps 218*a* and 218*b*. In this embodiment, clamps 218*a* and 218*b* are screw clamps, each having a lever 242 (see FIG. 9) coupled to first side 214 of body 202. Lever 242 can be tightened and/or loosened by a screw to provide for the lever to retain the sampling bag against the body 202.

FIG. 10 shows another embodiment of a carrier 300 having clamps 318*a* and 318*b*. In this embodiment, clamps 318*a* and 318*b* are magnet clamps, each having a magnet 348 that is attracted to body 302. A user or a robot can move the clamp between a first position and a second position by removing and returning the magnet 348 to the position shown in FIG. 10. Magnet 348 is of sufficient strength to retain the sampling bag and sample therein against the carrier 300.

Figure 11:
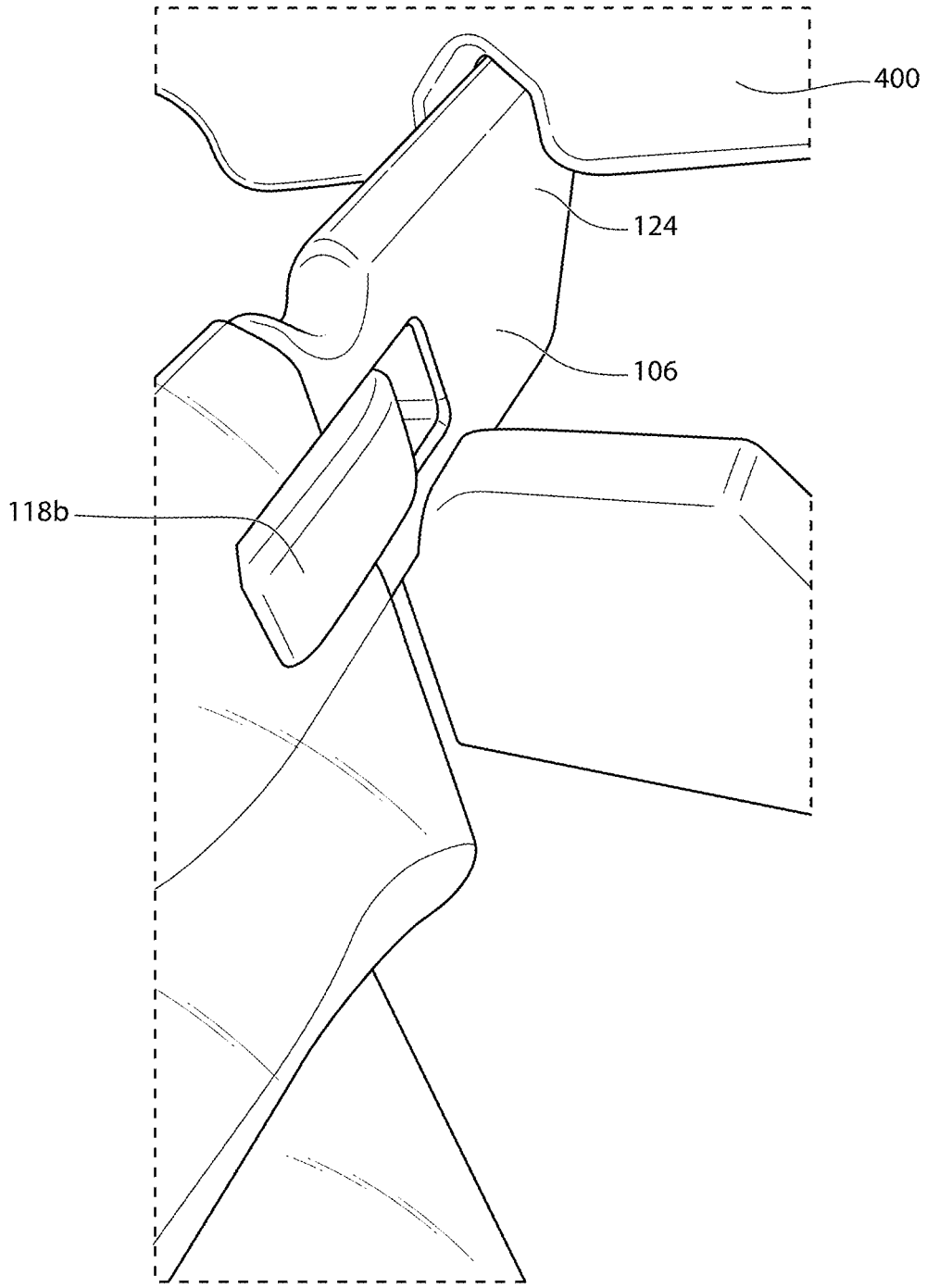
FIG. 11 is a magnified view of a second segment of the carrier of FIG. 1 attached to a rack.
Figure 12:
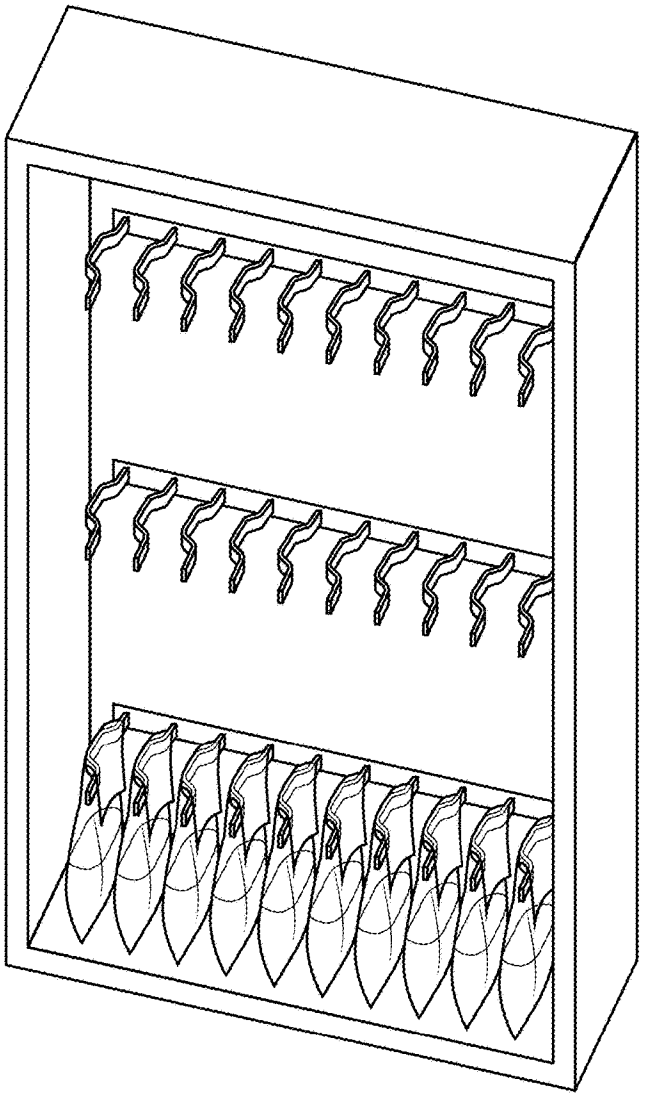
FIG. 12 is a perspective view of a collection of carriers according to at least one embodiment described herein being stored in a storage system.

Turning now to FIG. 11, shown therein is a magnified view of free end 124 of second segment 106. Second segment 106 may be configured to be retained in a rack, or shelving unit, such as rack 400 shown in FIG. 11 within, for example, a storage system 500 as shown in FIG. 12. For example, second segment 106 may include one or more grooves, and/or notches, 160 that engage with features of rack 400 to support any carrier 100, 200, 300. Further, it should be understood that the carriers described herein may also be supported by other structures, such as but not limited to the structures shown in in FIGS. 5 and 8 during a filling process.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A carrier for a sampling bag, the carrier comprising:

a body having:

a first segment;

a second segment; and a central segment integrated with and connecting the first segment and the second segment, a portion of the central segment being laterally spaced apart from a longitudinal axis of the body, the first segment and the second segment being coaxial with the longitudinal axis; and a pair of clamps including a first clamp positioned on the first segment of the body and a second clamp positioned on the second segment of the body, the first clamp retaining the sampling bag against a first side of the first segment of the body and the second clamp retaining the sampling bag against a first side of the second segment of the body, the portion of the central segment being laterally spaced from the first side of the first segment and the first side of the second segment to provide for two pieces of plastic forming sides of the sampling bag to be pulled apart from each other in a direction away from each other to open the sampling bag when the sampling bag is hanging downwardly relative to the body.

2. The carrier of claim 1, wherein the first segment includes a free end and a joined end, the joined end being coupled to the central segment of the carrier.

3. The carrier of claim 1, wherein the second segment includes a free end and a joined end, the joined end being coupled to the central segment of the carrier.

4. The carrier of claim 1, wherein the central segment comprises a first portion and a second portion, the first portion of the central segment being coupled to the joined end of the first segment and the second portion of the central segment being coupled to the joined end of second segment.

5. The carrier of claim 4, wherein the central segment further comprises a middle portion coupled to each of the first portion and the second portion.

6. The carrier of claim 1, wherein the pair of clamps includes a first clamp and a second clamp, the first clamp being positioned between the free end and the joined end of the first segment and the second clamp being positioned between the free end and the joined end of the second segment.

7. The carrier of claim 6, wherein each clamp of the pair of clamps is one of a c-clamp, a screw clamp, a hand screw clamp, a spring clamp, a bar clamp, a hose clamp, a magnetic clamp, a pneumatic clamp, and a clip.

8. The carrier of claim 1, wherein the body has a ribbon-like shape having a length greater than a height and the height greater than a thickness.

9. The carrier of claim 1, wherein the body has a ribbon-like shape having a length greater than a height and the height less than a thickness.

10. The carrier of claim 8, wherein the body as a top edge, a bottom edge, the first side and a second side, the first side and the second side extending between the top edge and the bottom edge.

11. The carrier of claim 8, wherein the central segment is offset laterally in a direction towards the second side of the body.

12. The carrier of claim 8, wherein each clamp of the pair of clamps is a compression clamp having a spring coupled to the second side of the body and a lever hingedly coupled to the spring and extending though an aperture of the body, the lever being configured to retain the sampling bag against the body of the carrier.

13. The carrier of claim 12, wherein the lever has an inner surface and an outer surface, the inner surface contacting the sampling bag when each clamp is in a first position.

14. The carrier of claim 11, wherein each clamp has a first position and a second position and is biased to the first position, the first position being configured to retain the sampling bag against the carrier and the second position being configured to release the sampling bag from the carrier.

15. The carrier of claim 11, wherein the lever has a U-shape.

16. The carrier of claim 1 further comprising a radio frequency identification (RFID) tag positioned on a first end of the carrier.

17. The carrier of claim 1, wherein a first end of the carrier is configured to be held by a gripper of a robot or manipulator.

18. The carrier of claim 17, wherein the carrier includes a second end spaced from the first end, the second end being configured to be retained in a rack of a sampling bar carrier shelving unit.

* * * * *